United States Patent [19]

Pleet

[11] Patent Number: 4,921,135

[45] Date of Patent: May 1, 1990

[54] PRESSURIZED BEVERAGE CONTAINER DISPENSING SYSTEM

[76] Inventor: Lawrence Pleet, No. 9 Flintlock La., Bell Canyon, Calif. 91307

[21] Appl. No.: 318,596

[22] Filed: Mar. 3, 1989

[51] Int. Cl.[5] ..... B67B 7/24

[52] U.S. Cl. ..... 222/82; 222/91; 222/95; 222/105; 222/146.6; 222/396

[58] Field of Search ..... 62/3.64; 222/91, 82, 222/81, 95, 105, 146.6, 183, 396, 401, 386.5, 389

[56] References Cited

U.S. PATENT DOCUMENTS

| | | | |
|---|---|---|---|
| 1,086,532 | 2/1914 | Huss | 222/95 |
| 2,026,238 | 12/1935 | Loane et al. | 222/401 |
| 2,564,163 | 8/1951 | Leperre | 222/95 |
| 2,762,534 | 9/1956 | Kish . | |
| 2,814,418 | 11/1957 | Rieke | 222/91 |
| 3,243,965 | 4/1966 | Jepson | 62/3,64 |
| 3,244,326 | 4/1966 | Bull, Jr. . | |
| 3,294,289 | 12/1966 | Bayne et al. | 222/95 |
| 3,315,846 | 4/1967 | Landis et al. | 222/81 |
| 4,098,434 | 7/1978 | Uhlig . | |
| 4,147,278 | 4/1979 | Uhlig . | |
| 4,264,019 | 4/1981 | Roberts et al. | 222/95 |
| 4,469,250 | 9/1984 | Evezich . | |
| 4,785,974 | 11/1988 | Rudick et al. | 222/105 |

*Primary Examiner*—H. Grant Skaggs

*Attorney, Agent, or Firm*—Poms, Smith, Lande & Rose

[57] ABSTRACT

A countertop pressurized beverage system includes an outer housing, and an inner flexible Mylar bag containing a potable liquid, such as beer or a carbonated beverage, requiring pressurization. A closed plastic container capable of withstanding substantial pressure encloses the flexible bag, and is mounted with the housing. A compressor supplies air to the closed plastic container at a pre-set level, in order to maintain carbonation in the potable liquid. A thermoelectric cooling unit is mounted on the bottom of the countertop unit to provide cooling, to a plate which is mounted in thermally conductive proximity below the closed plastic housing at the bottom thereof where the flexible bag rests against the bottom of the plastic container. A cap makes threaded engagement with mating threads on a wide mouth opening on the closed plastic container; and the cap has an inwardly extending central tube around which the mouth of the flexible bag is secured. A closure plug is threaded at the center of the cap, and a spigot assembly may be screwed into the closure cap and perforates the inner wall thereof, so that fluid may be dispensed from the flexible bag through the spigot. A spigot may be screwed into the center of the cap, thereby avoiding the need for a closure plug. Means other than perforation may be used by the spigot assembly to disengage the closure plug.

19 Claims, 3 Drawing Sheets

Fig. 1.
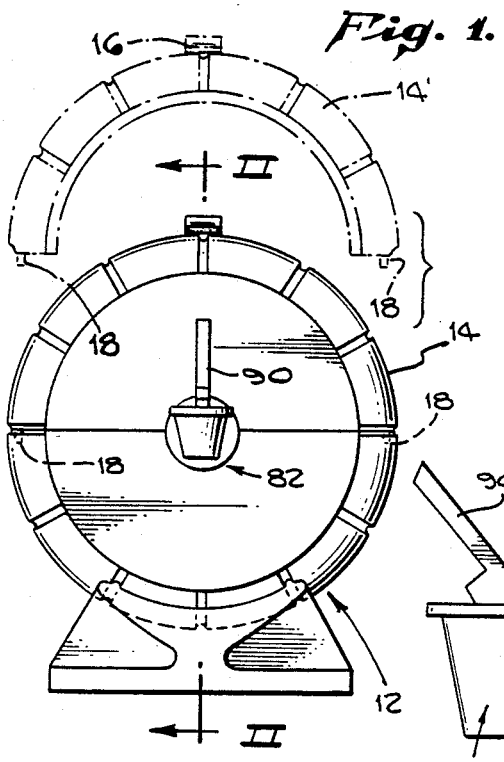
Fig. 3.
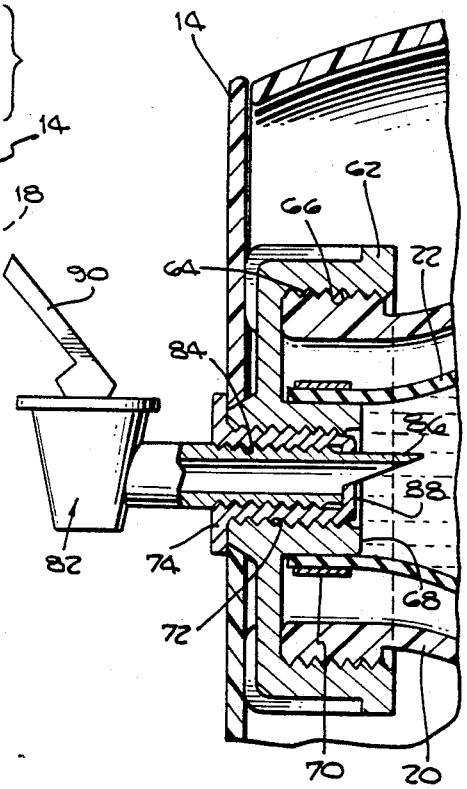
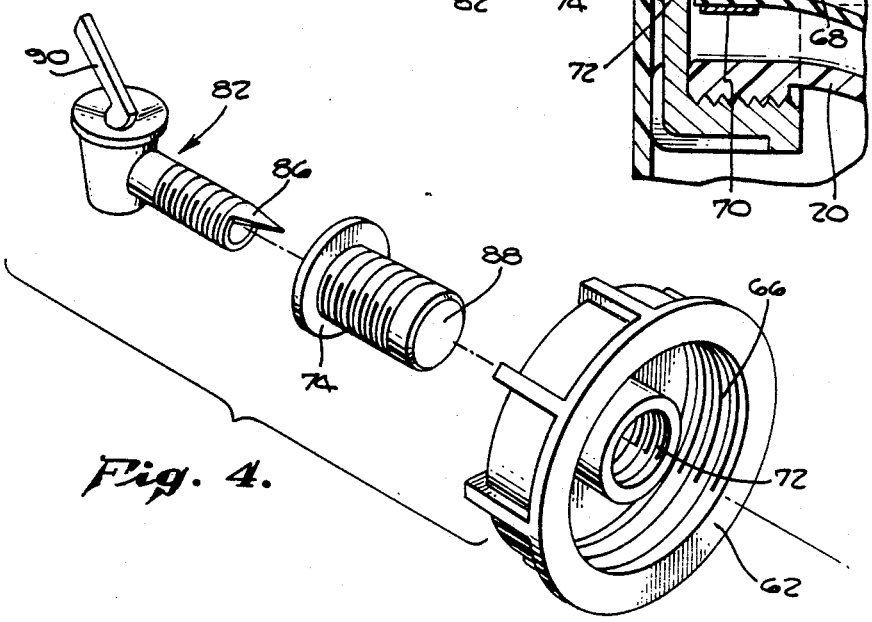
Fig. 4.

PRESSURIZED BEVERAGE CONTAINER DISPENSING SYSTEM

FIELD OF THE INVENTION

This invention relates to a beverage container dispensing system for maintaining relatively large volumes of beer or carbonated beverages at cool and appropriate pressure levels.

BACKGROUND OF THE INVENTION

Current commercial method of selling carbonated beverages include cans and bottles. Beer is sold in re-usable metal kegs which require carbon dioxide cartridges to maintain carbonation. These kegs are heavy and require special refrigerated dispenser units or are cooled by ice. A product known as the "Party Ball" has recently been developed; and this involves a five-gallon plastic ball with a re-usable dispenser spigot at the top of the ball. This "party ball" is pressurized by a hand pump which must be activated after two or three 8-oz. glasses are dispensed. Since only air is supplied to the compartment, the beer must be consumed within about 24 to 48 hours before it loses carbonation and becomes flat. These methods of beer dispensing in large quantities are cumbersome, expensive, and impractical for many purposes.

Soft drink carbonated beverages are not available in large size units, because once they are opened, they rapidly lose carbonation pressure.

Non-carbonated beverages have been made available in flexible bags, equipped with a dispensing spout, and A. M. Pike, Jr. U.S. Pat. No. 3,435,990 shows a cooling apparatus in which three of such flexible beverage containing bags are used. However, the Pike system is not applicable to potable beverages requiring pressurization, such as beer or carbonated soft drinks, for specific examples.

Accordingly, a principal object of the present invention is to provide a system for economically dispensing large quantities of beer or other carbonated beverages without the disadvantages outlined hereinabove.

SUMMARY OF THE INVENTION

In accordance with a specific illustrative embodiment of the present invention, a countertop pressurized beverage dispensing system includes an outer housing, a flexible bag containing a potable liquid, such as beer or a carbonated beverage requiring pressurization, and a closed, plastic container capable of withstanding substantial pressure enclosing the flexible bag. An air compressor is provided for supplying air to the plastic container to maintain pressure on the flexible bag, as the beer or carbonated beverage is dispensed from the flexible bag, with a consequent reduction in its size and volume, within the plastic container. A pressure-sensing switch controls the activation of the compressor, to maintain the desired level of carbonation of the beverage. In addition, suitable cooling arrangements may be provided; and preferably, this is in the form of thermoelectric cooling arrangements involving a cooling plate within the outer housing, and in engagement with the bottom of the plastic container upon which the flexible bag rests.

For containing beer, the outer housing preferably in the configuration of a barrel or keg; while for containing other liquids, the housing may be substantially rectangular in its configuration. Other shapes may be employed.

The plastic container preferably has a relatively wide mouth aperture approximately 3 or 4 inches in diameter through which the flexible bag, which may, for example, be formed of Mylar, attached to a cap, may be inserted. The cap is preferably provided with screw threads which interfit with mating screw threads on the plastic container.

In accordance with another feature of the invention, a closure plug may be mounted at the center of the cap, and a dispensing valve may be provided which pierces the closure plug as the dispensing valve is threaded into the internal threads of the closure plug, thereby permitting direct dispensing of the contents of the flexible bag through the dispensing valve. The dispensing valve may be inserted after filling of the bag and thereby act as a closure plug. This dispensing valve would be disposable as is the entire package, including the plastic container and enclosed flexible bag.

In accordance with another feature of the invention, the cap includes threads for securing it to the plastic container, and means for securing the flexible bag to an inner portion of the cap, and arrangements for securing a dispensing valve to the end of the cap for direct coupling to the inside of the flexible bag.

Preferably, in practice, the flexible bag is initially secured to a central inwardly directed hollow extension of the cap, the bag is then mounted inside the plastic container while the bag is still empty, the bag is then filled with beer or other carbonated beverage, and the perforatable closure plug or dispensing valve is then screwed into the central opening in the cap through which the flexible bag was filled. Later, when the plastic container has been mounted within the housing, the dispensing valve is screwed into the inner threads within the perforatable closure plug so that the carbonated beverage contents of the flexible bag may be dispensed through the dispensing valve. The plastic container has a fitting which mates with a fitting from the air compressor mounted on the housing, and, once the plastic container is mounted within the housing and coupled to the compressor, the unit is energized by connecting to an electric wall outlet, and the compressor and thermoelectric cooling arrangements are set into operation.

Other objects, features and advantages of the invention will become apparent from a consideration of the following detailed description and from the accompanying drawings.

BRIEF DESCRIPTION OF THE DRAWINGS

FIG. 1 is a front view of a countertop pressurized beverage container illustrating the principles of the present invention;

FIG. 3 is a cross-sectional view of the front of the unit of FIGS. 1 and 2, showing the cap, the dispensing valve, the flexible Mylar bag in which the carbonated beverage is located, and the enclosing plastic container;

FIG. 4 is an exploded view of the dispensing valve, the perforatable sealing member, and the cap for the plastic container;

DETAILED DESCRIPTION OF PREFERRED EMBODIMENT

Figure 2:
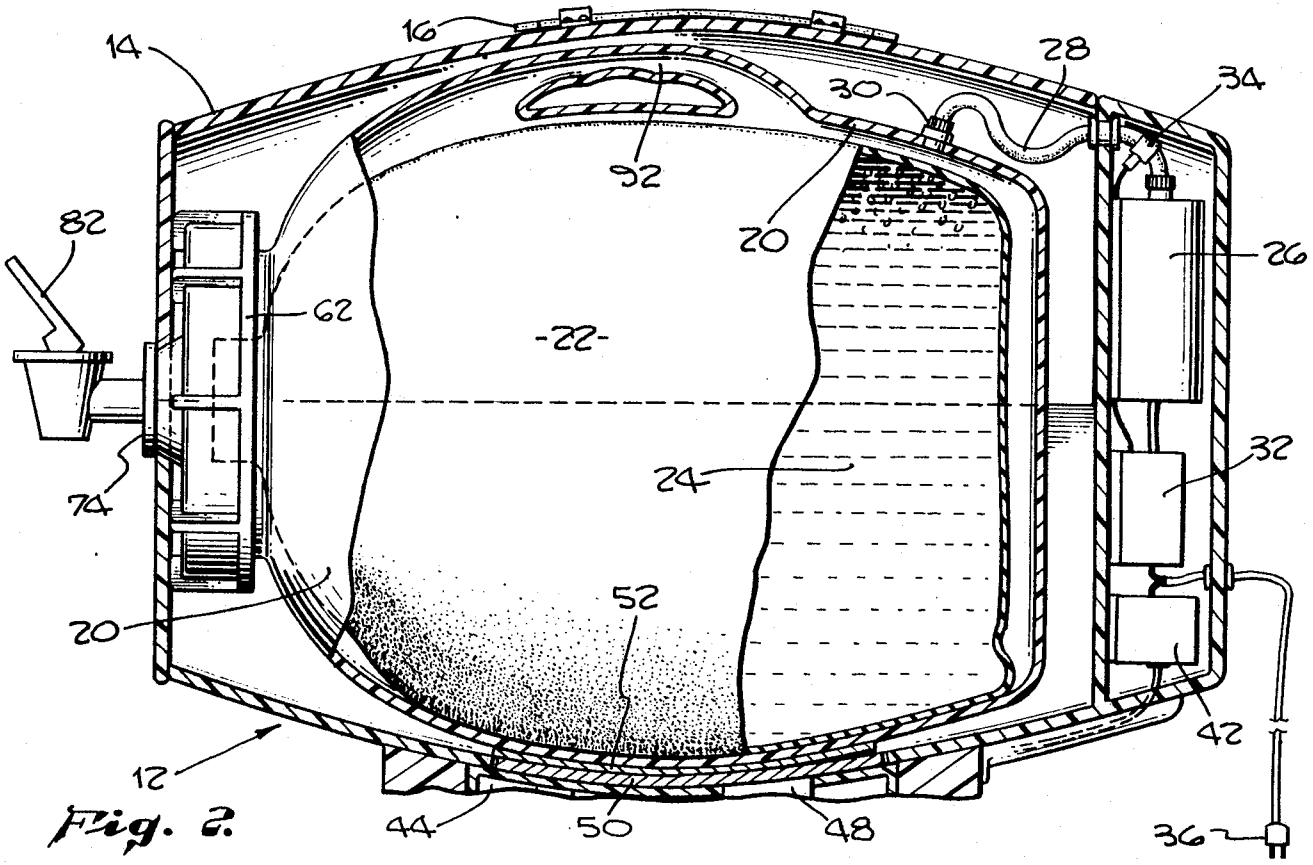
FIG. 2 is a side view of the unit of FIG. 1 shown in partial cross-section.

Referring more particularly to the drawings, FIG. 1 shows a countertop unit illustrating the principles of the invention and including a lower base section 12 and a removable upper section 14, with the upper section 14 being shown at 14' in the removed configuration. The upper portion 14 may be provided with a handle 16 for lifting it off the lower base section 12. In addition, the removable section 14 has downwardly extending elements 18 which engage the inner wall of the lower section 12 and hold the upper portion 14 in its proper orientation relative to the base portion 12.

Referring now to FIGS. 2 and 3, within the housing formed of the base portion 12 and the removable upper portion 14, is a plastic housing 20 capable of withstanding substantial pressures, such as 50 or 60 psi. Within the relatively strong plastic container 20 is a flexible, Mylar bag 22 containing beer or other potable carbonated beverage 24. In FIGS. 2 and 3, the flexible plastic bag 22 has very thin walls, a few thousands of an inch thick, but is shown thicker for disclosure purposes. In order to maintain pressure on the carbonated beverage 24 within the flexible Mylar bag 22, a compressor 26 is provided to supply pressure through the conduit 28 and the releasable coupling 30 to the plastic container 20. A pressure switch 32 is coupled to the conduit 28 by the T-fitting 34, and senses the pressure level at the output of the compressor 26, which is substantially the same as the pressure within the plastic container 20. Power is supplied to the unit from the plug 36, and this power is applied to the pressure switch 32 and selectively permitted to energize the compressor 26. Incidentally, any suitable small-size compressor may be employed but one suitable unit, which is a diaphragmatic compressor is available from A.S.F. Industries, 4570 S. Berkely Lake Road, Norcross, Ga. 30071-1639. The model number is Model 7010D 115 V/60 cycles, No.2 ASF No. 7010-000-PP. The compressor size is approximately 7 inches by 2½ inches by 2¾ inches. The pressure switch may be any suitable pressure-sensitive switch, but one operative pressure switch is Type 40, Model 230, Stock No. 9624, available from A. Biederman, Inc., 627 Hazel Street, Glendale, Calif. 91201-3095.

The 60 cycle, 110 volt, electric power from plug 36 may also be supplied to the transformer 42, which in turn supplies low voltage to the thermoelectric cooling unit 44. The thermoelectric cooling unit 44 includes the fan 46 and the thermoelectric unit per se, designated by the reference numeral 48.

Thermoelectric coupling devices, such as the unit 48, operate as a solid state heat pumps. The cold junction of the device is that junction which will absorb or remove heat from an intended "cold surface", such as the inner conductive surface 50, and the plate 52, which is in thermally conductive proximity to the plastic container 20 and to the flexible bag 22 which rests on the lower surface of the plastic container 20. Incidentally, the bag 22 is of very thin Mylar or other plastic material and is very flexible, but is shown with significant thickness in the drawings, for purposes of clarity. Continuing with a description of the thermoelectric unit 44, the heat absorbed at the cold junction, which is intimate contact with the thermally conductive member 50, is pumped to the hot junction at a rate proportional to the current passing through the circuit. Thermoelectric cooling couples may be made using two elements of semiconductors, such as bismuth telluride, heavily doped to create either an excess (n-type) or a deficiency (p-type) of electrons. Current flowing through a series thermoelectric circuit will cool one junction and heat the other junction in accordance with known thermoelectric principles.

Figure 5:
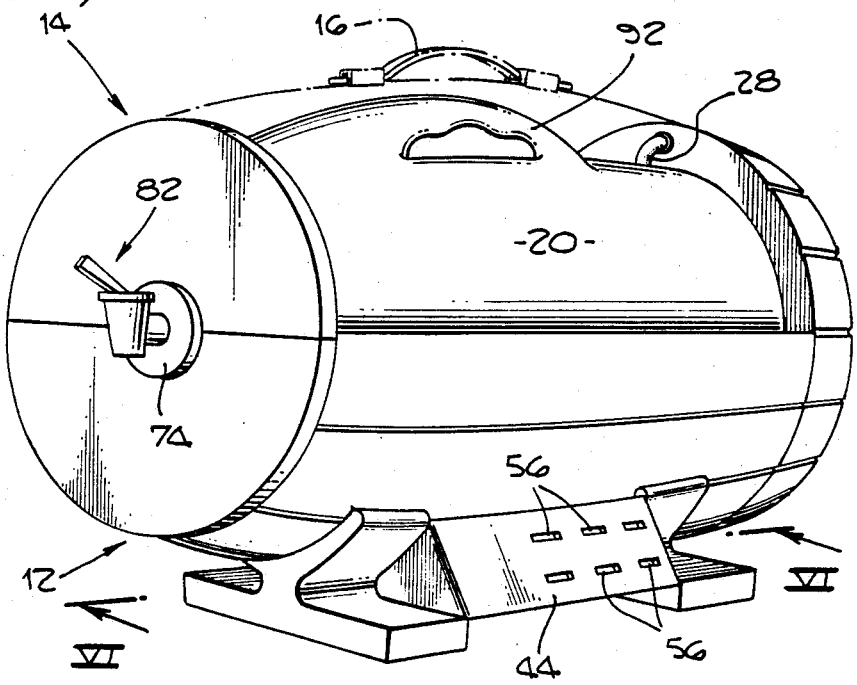
FIG. 5 is a perspective view of the countertop pressurized beverage container unit of FIGS. 1 through 4.
Figure 6:
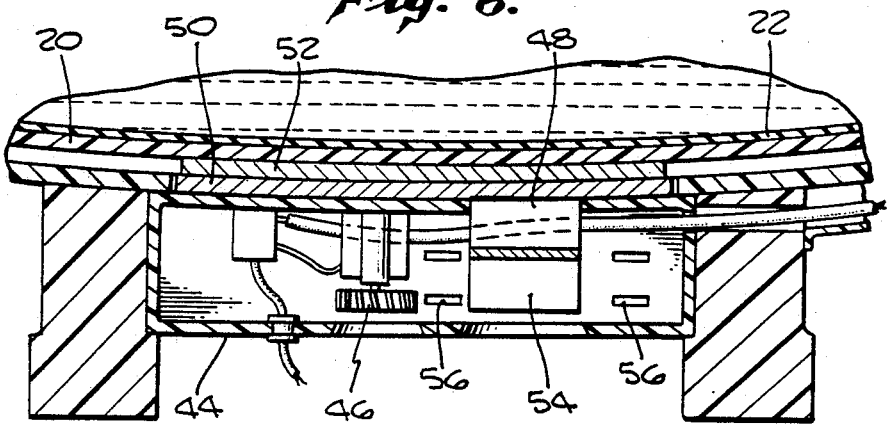
FIG. 6 is an enlarged cross-sectional view of the thermoelectric cooling unit.

The hot junction at the outer side to unit 48 is cooled through the use of the fins 54, and the fan 46, which draws air in from below the unit, and directs the air past the fins 54 and out the vent holes 56, as shown for example in FIGS. 5 and 6 of the drawings.

Thermoelectric devices normally work at relatively low D.C. voltages; and accordingly, the stepdown transformer 42 is provided, and a series rectifier provides the direct current supplied to the thermoelectric unit 48. A suitable temperature sensing and automatic energization control circuit for the thermoelectric device 48 and the fan 46 is provided.

Now, turning to FIGS. 3 and 4, consideration will be given to the cap 62. The outer plastic container 20 is provided with an enlarged opening or mouth, and has external threads 64, which mate with the internal threads 66 of the cap 62. Initially, the flexible Mylar bag 22 is secured to the inwardly-directed circular portion 68 of the cap 62 by a suitable clamping band 70, or any other desired means. At the center of the cap 62 is the threaded opening 72 into which the perforatable closure plug 74 is threaded. Of course, prior to the insertion of the plug 74, the empty flexible bag 22 is mounted within the plastic container 20, and the cap 62 is threaded firmly onto the mouth of the plastic container 20. Then the flexible bag 22 is filled with the carbonated beverage, with the closure plug 74 being screwed in place immediately thereafter, or a dispensing valve may be screwed in place replacing the perforatable closure plug and acting as both a closing plug and dispensing valve. Later, when the plastic container is mounted within the housing 12, 14, with the compressor coupling 30 being securely connected, the dispensing spigot assembly 82 may be threaded into the internal threads 84 of the plug 74. The sharp point 86 at the front end of the spigot assembly 82 pierces the wall 88 at the inner end of the plug 74, and the carbonated beverage may now be dispensed by the actuation of the lever 90 on the spigot assembly 82.

Incidentally, the plastic container 20 may be provided with a handle 92 to facilitate lifting and transporting the plastic container when it is filled with liquid within the inner flexible bag.

It may be noted that the base section 12 and the upper section 14 of the unit housing are provided with recesses which fit around the dispensing spigot 82, between the lip 74 of the closure plug and the cap 62, as best shown in FIG. 3.

In conclusion, it is to be understood that the foregoing detailed description and the accompanying drawings illustrate one preferred embodiment of the invention. Variations from this preferred design may, of course, be made. Thus, by way of example and not of limitation, while the keg configuration is to be preferred for beer, rectangular or other configurations may be used for carbonated soft drinks, for example. Further, instead of thermoelectric cooling, conventional compression and expansion-type cooling may be employed In addition, instead of using separate motors for the fan, for the air compressor, and power arrangements for the thermoelectric cooling unit, a single motor may power both the air compressor and a compressor for the cooling system, or the fan. The pressure switch 32 may be coupled to the wall of the plastic container, and be actuated by movement thereof, instead of the arrangements shown. Instead of a pressure-sensing switch, a relief valve may be provided to avoid overpressure operating the compressor. Accordingly, it is to be understood that the invention is not limited to the precise arrangements shown in the drawings and as described hereinabove.

What is claimed is:

1. A countertop pressurized beverage dispensing system comprising:

an outer housing;

a flexible bag containing a potable liquid, such as beer or a carbonated beverage, requiring pressurization;

means, including a closed plastic container capable of withstanding substantial pressure, for enclosing said flexible bag;

compressor means for supplying pressurized air into said plastic container;

pressure-sensing means for actuating said compressor means to maintain a predetermined desired pressure within said plastic container to apply pressure to said flexible bag and the enclosed potable liquid;

means for dispensing said potable liquid from said flexible bag;

thermoelectric means for cooling the potable liquid in said bag;

said plastic container having an opening at least 2 inches in diameter, said container having a first set of threads extending around said opening;

a cap making threaded engagement with said first set of threads;

a threaded perforatable closure plug mounted in a central threaded opening in said cap; and said means for dispensing including a dispensing valve assembly having external threads for mating with internal threads in said plug, and means forming part of said assembly for perforating said plug as said valve assembly is threaded into said plug, to permit dispensing of the cooled carbonated beverage through said valve assembly.

2. A countertop pressurized beverage system as defined in claim 1 wherein a thermally conductive cooling plate is mounted under and in engagement with said closed plastic container, and wherein said cooling plate is in thermally conductive relationship with said thermoelectric cooling assembly.

3. A countertop pressurized beverage system as defined in claim 1 wherein said outer housing is in the form of a beer barrel or beer keg.

4. A countertop pressurized beverage system as defined in claim 1 wherein said outer housing has a base portion and an upper portion which may be raised from said base portion to receive said closed plastic container and wherein said base and upper portions have opposed notches forming an opening through which said dispensing means extends.

5. A countertop pressurized beverage system as defined in claim 4 wherein a thermally conductive cooling plate is mounted under and in engagement with said closed plastic container, and wherein said cooling plate is in thermally conductive relationship with said thermoelectric cooling assembly.

6. A countertop pressurized beverage system as defined in claim 1 wherein said cooling means is a thermoelectric cooling assembly.

7. A countertop pressurized beverage system comprising:

an outer housing;

a flexible bag containing a potable liquid, such as beer or a carbonated beverage, requiring pressurization;

means, including a closed plastic container capable of withstanding substantial pressure, for enclosing said flexible bag;

means for supplying pressurized gas into said plastic container;

pressure-sensing means for actuating said means for supplying pressurized gas, to maintain a predetermined desired pressure within said plastic container to apply pressure to said flexible bag and the enclosed potable liquid;

means for dispensing said potable liquid from said flexible bag; and means for cooling the potable liquid in said bag.

8. A countertop pressurized beverage system as defined in claim 7 wherein said plastic container has an opening at least 2 inches in diameter and a first set of threads extending around said opening; a cap is provided for making threaded engagement with said first set of threads; and a threaded perforatable closure plug is mounted in a central threaded opening in said cap.

9. A countertop pressurized beverage system as defined in claim 8 wherein said dispensing means includes a dispensing valve assembly having external threads for mating with internal threads in said plug, and means forming part of said assembly for perforating said plug as said valve assembly is threaded into said plug, to permit dispensing of the cooled carbonated beverage through said valve assembly.

10. A countertop pressurized beverage system as defined in claim 7 wherein said cooling means is a thermoelectric cooling assembly.

11. A countertop pressurized beverage system as defined in claim 10 wherein a thermally conductive cooling plate is mounted under and in engagement with said closed plastic container, and wherein said cooling plate is in thermally conductive relationship with said thermoelectric cooling assembly.

12. A countertop pressurized beverage system as defined in claim 7 wherein said means for supplying pressurized gas is an air compressor.

13. A countertop pressurized beverage system as defined in claim 7 wherein said outer housing is in the form of a known type of container for pressurized beverages.

14. A countertop pressurized beverage system as defined in claim 7 wherein said outer housing has a base portion and an upper portion which may be raised from said base portion to receive said closed plastic container and wherein said base and upper portions have opposed notches forming an opening through which said dispensing means extends.

15. A pressurized beverage unit comprising:

an outer housing;

a flexible bag containing a potable liquid, such as beer or a carbonated beverage, requiring pressurization;

means, including a closed container capable of withstanding substantial pressure, for enclosing said flexible bag;

means for supplying pressurized gas into said plastic container;

means for dispensing said potable liquid from said flexible bag;

means for cooling the potable liquid in said bag; and said closed container having an opening at least 2 inches in diameter and a first set of threads extending around said opening; a cap making threaded engagement with said first set of threads; and a threaded perforatable closure plug mounted in a central threaded opening in said cap.

16. A countertop pressurized beverage system as defined in claim 15 including means for controlling the pressure within said closed container.

17. A countertop pressurized beverage system as defined in claim 15 wherein said means for dispensing includes a dispensing valve assembly having external threads for mating with internal threads in said plug, and means forming part of said assembly for perforating said plug, or otherwise disengaging said plug, as said valve assembly is threaded into said plug, to permit dispensing of the cooled carbonated beverage through said valve assembly.

18. A countertop pressurized beverage system as defined in claim 15 within said outer housing is in the form of a known type of container for pressurized beverages.

19. A countertop pressurized beverage system as defined in claim 15 wherein said outer housing has a base portion and an upper portion which may be raised from said base portion to receive said closed container and wherein said base and upper portions have opposed notches forming an opening through which said dispensing means extends.

* * * * *